US008978184B1

(12) United States Patent
Garrett

(10) Patent No.: US 8,978,184 B1
(45) Date of Patent: Mar. 17, 2015

(54) PATIENT MOVEMENT ASSIST DEVICE

(71) Applicant: Rick Garrett, Dalton, GA (US)

(72) Inventor: Rick Garrett, Dalton, GA (US)

( * ) Notice: Subject to any disclaimer, the term of this patent is extended or adjusted under 35 U.S.C. 154(b) by 128 days.

(21) Appl. No.: 13/745,901

(22) Filed: Jan. 21, 2013

(51) Int. Cl.
*A61G 7/10* (2006.01)
*A61G 7/00* (2006.01)

(52) U.S. Cl.
CPC ..... *A61G 7/001* (2013.01); *A61G 7/1009* (2013.01); *A61G 7/1021* (2013.01)
USPC ..... 5/715; 5/615; 5/604; 5/713; 4/456

(58) Field of Classification Search
CPC ..... A61G 7/1021; A61G 9/00; A61G 9/02
USPC ..... 5/604, 615, 655.3, 710, 713, 715; 4/456
See application file for complete search history.

(56) References Cited

U.S. PATENT DOCUMENTS

| | | | | | |
|---|---|---|---|---|---|
| 3,775,781 | A * | 12/1973 | Bruno et al. | ..... | 5/607 |
| 3,935,604 | A * | 2/1976 | Collins | ..... | 5/630 |
| 4,207,633 | A * | 6/1980 | Smith et al. | ..... | 5/632 |
| 4,941,221 | A * | 7/1990 | Kanzler | ..... | 5/615 |
| 4,977,629 | A * | 12/1990 | Jones | ..... | 5/632 |
| 6,119,292 | A * | 9/2000 | Haas | ..... | 5/715 |
| 6,223,368 | B1 * | 5/2001 | Anslin | ..... | 5/630 |
| 7,007,330 | B2 * | 3/2006 | Kuiper et al. | ..... | 5/715 |

* cited by examiner

*Primary Examiner* — Michael Trettel
(74) *Attorney, Agent, or Firm* — Stephen J. Stark

(57) ABSTRACT

A patient moving station provides fluid bladders connected to a fluid transfer station. Fluid, preferably air, is provided to a first compartment to lift the buttocks of a patient to provide a gap to assist in changing diapers. Second and third compartments below shoulders are useful to inflate and deflate to turn the patient.

9 Claims, 3 Drawing Sheets

PATIENT MOVEMENT ASSIST DEVICE

BACKGROUND OF THE INVENTION

The present invention relates to a method and apparatus for assisting in the movement of bed-ridden patients, and more particularly to a method and apparatus for pressurizing and depressurizing at least one bladder disposed below a patient to elevate at least a portion of the patient to preferably assist in turning the patient for such actions as changing the diaper of an Alzheimer or other appropriate patient and/or moving a patient to reduce a likelihood of bed sores developing.

DESCRIPTION OF RELATED ART

In nursing homes, assisted living facilities, home health care situations, and hospitals and possibly other situations, it is possible to encounter patients that are bed ridden. If a patient is unable to move from a particular location in bed, it is usually necessary to move the patient at least once every two to four hours to prevent bed sores from developing where the weight of the person rests against the bed. Severe bed sores can be painful, extremely expensive to treat and can even kill patients. Reducing bed sores would be advantageous.

Additionally the movement of patients can be awkward, especially when changing diapers, for those patients that require such articles. For caregivers to stand over a person in a bed, lift one side of the person and try to slide a diaper underneath at least part of the person while cleaning them and disposing of the spent diaper, it is possible for the caregiver(s) to unintentionally strain their back due to leaning and pulling at the same time. Furthermore, two caregivers are not really assigned this task. Reducing the number of caregivers and/or risk to caregivers would be advantageous as well.

SUMMARY OF THE INVENTION

Accordingly, it is an object of the present invention to provide a method and device for assisting the movement of a patient that is in a prone position and not able to consistently move their weight for a caregiver.

It is another object of the present invention to provide a device to assist in the movement of a patient to prevent a caregiver from attempting to pick up a significant portion of the weight of an individual for such routine chores as changing diapers and shifting weight load to prevent bed sores.

Another object of the present invention to provide a device and method for elevating at least a portion of a patient relative to a bed for assisting in changing diapers and/or other functions.

It is yet another object of the present invention to provide a method and device for assisting in turning a patient in bed.

Another object of the present invention is to provide a method and device for assisting in the changing of diapers.

Accordingly, at least one bladder or compartment which can be filled with air or other fluid is disposed intermediate a portion of a bed and at least a portion of a patient. The bladder is at least partially inflated to elevate at least a portion of a patient relative to the bed. In the preferred embodiment, a gap is then created in the area of the buttocks relative to the bed so that a caregiver could then potentially slide their hand and one or more diapers below the buttocks of a person to assist in cleaning and changing.

Furthermore, by having one or more compartment(s) of air immediately below the portion of the torso of the individual, especially when utilizing more than one air compartment, air can be selectively let out of the one or more bladders to assist and the patient pushed with relatively little force to relatively easily turn the patient. This is particularly an attractive option for changing diapers. Additionally, the ability to turn patients in this manner is extremely helpful to prevent the occurrence of bed sores. Finally, this method and apparatus in the presently preferred embodiment has been found to be able to be performed by a single operator regardless of the weight of the patient (i.e., patients in excess of 200 pounds have been easily manipulated by extremely small caregivers). At least some embodiments may at least partially inflate/deflate certain areas automatedly as controlled by a controller or processor in an effort to prevent and/or alleviate bedsores.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
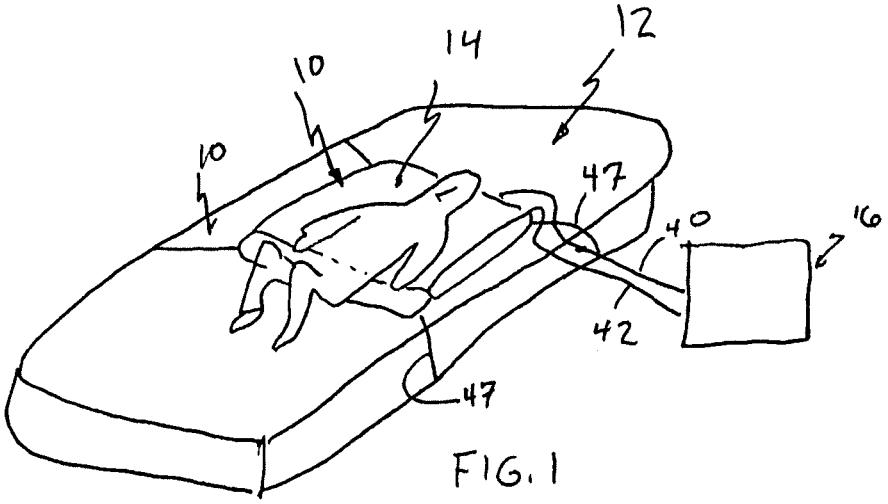
FIG. 1 shows a patient in a hospital bed prior to inflating the a first preferred embodiment of the present invention in the course of the preferred method of its operation.

FIG. 1 shows a patient 10 on a hospital bed 12 and a moving or turning assembly 14 constructed in accordance with a first embodiment of the present invention. The patient 10 could be any size person, even extremely heavy, depending upon the particular embodiment selected. The bed 12 is provided for illustration purposes. It could be a hospital bed, the bed of a patient at home, the floor or any surface on which a patient 10 is desired to be moved relative thereto. The turning assembly 14 is illustrated in the first embodiment. It will be obvious to others skilled in the art that various other embodiments can be provided utilizing the technique as shown and described herein.

Figure 2:
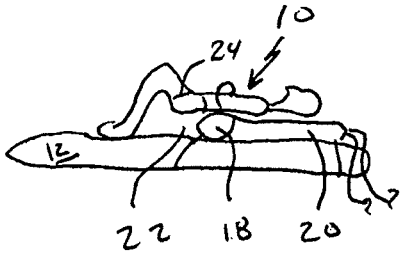
FIG. 2 shows a side plan view of the patient partially elevated utilizing the first preferred embodiment of the present invention to create a space between the portion of the buttocks of the patient and the bed for such use as changing diapers.

The moving assembly 14 is shown illustrated connected to a fluid transfer system 16 such as an air pump, but other fluid such as air, etc., could be utilized for the moving assembly 14 as will be described in further detail below. Other embodiments may have more complicated fluid transfer systems 16 as will be described below. Upon activation of the fluid transfer system 16, air or other fluid is pumped into at least one if not several compartments in the moving assembly 14. This is shown in FIG. 2 with one or more compartments being fully inflated. A first compartment 18 is illustrated right below the backbone or hips of the patient 10 while at least the second compartment 20 supports the weight of the torso and head. Of course, other compartments could be utilized as well. The first compartment 18 is illustrated so that it terminates to provide gap 22 to allow access below at least a portion of a diaper 24 as shown at least partially below the patient's hips, buttocks and/or spine. The gap 22 assists the caregiver in providing access below the diaper 24. This will assist the caregiver in being able to remove and/or replace the diaper 24. While the diaper 24 could be removed while the patient 10 is in the position in FIG. 2, FIGS. 5 and 6 are provided illustrative of the first preferred method of changing the diaper 24 of the patient 10.

Figure 3:
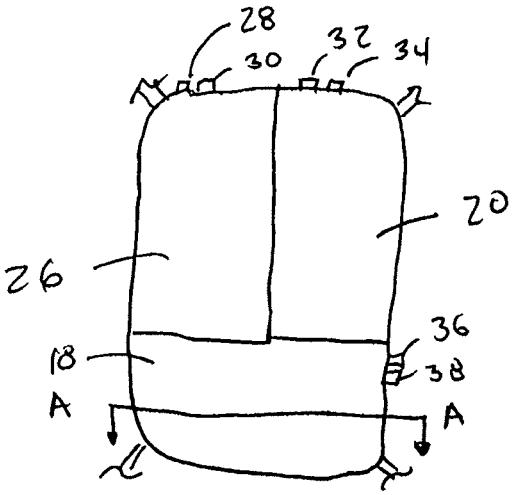
FIG. 3 shows a top plan view of the first preferred embodiment of the present invention.

FIG. 3 shows a third compartment 26 in addition to first and second compartments 18,20. Once or more valves 28,30,32, 34,36,38 are shown with their respective compartments 18,20,26. In other embodiments valves 28,30,32,34,36,38 and/or other may be supplemented and/or replaced with valve arrangements associated with and/or intermediate the fluid transfer system 16 and the moving assembly 14. It is possible to utilize inlet valves 28,32,36 and separate outlet valves 30,34,38. Alternatively, single valves or other valve arrangements could be utilized for such purposes. By providing two valves such as 28,30,32,34,36,38 for each of the respective compartments 18,20,26, one or more sets of inlet and outlet lines 40,42 could be provided from the fluid transfer system or station 16 so that the transfer station 16 could smoothly handle inflation and/or deflation. This would allow the fluid transfer system 16 to have a controller to relatively easily perform inflation and deflation as will be described in reference to FIGS. 2, 5 and 6 below. Of course, in other embodiments more or fewer valves cold be utilized to achieve similar results.

Figure 4:
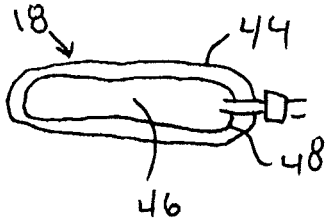
FIG. 4 shows a side cross sectional view of one of the bladders shown in FIG. 3.

FIG. 4 is useful to show that certain embodiments of the present invention can have fabric covering 44 over the respective compartments such as compartment 18. Fabric covering 44 over bladder can be fluid impenetrable or not. Furthermore, the bladder 46 may have a fabric or other outer surface 48 and/or covering somewhat akin to a pillow case or velour material on some air mattresses. There are a large plurality of different fabrics 44, exterior surfaces 48, and air bladder 46 material available on the market would be known to one of ordinary skill in the art. Straps 47 from the corners or other locations on the moving assembly 14 and/or covering 44 are useful in many embodiments. Elastic straps 47 connected with hook and loop fasteners to hospital beds have provided a comfort factor to users that the moving assembly 14 will not become moved inadvertently out from under a patient 10.

Figure 5:
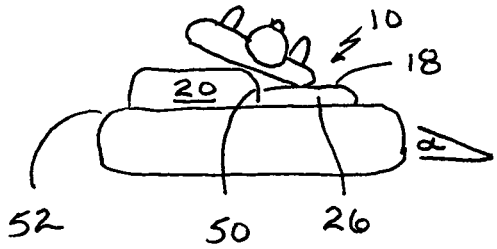
FIG. 5 shows operation of the preferred embodiments of the present invention to turn a patient looking on the head of the body.
Figure 6:
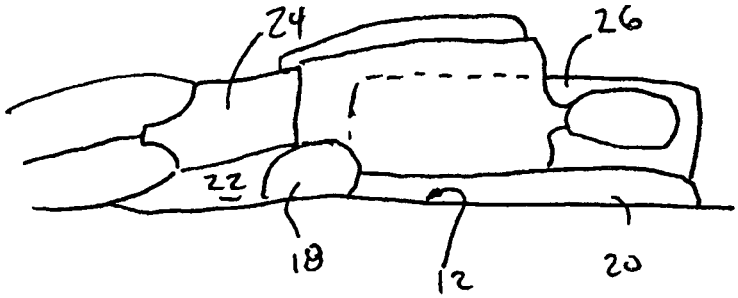
FIG. 6 is a side plan view showing a patient turned in an opposite direction than shown in FIG. 5 in accordance with a presently preferred embodiment of the present invention utilizing a preferred method.

FIG. 5 shows the second compartment 20 in a more inflated configuration than third compartment 26 and first compartment 18. As can be seen in FIG. 5, the patient 10 is located so that his spine is roughly approximately along the divider 50 intermediate second and third compartments 20,26 so that the shoulders are now angled at angle [alpha] $\acute{\alpha}$ relative to planar bed surface 52 depending on the degree of inflation and relative deflation of second and third compartments 20,26 respectively. More and more of the patient 10 can be turned to a higher degree of rotation $\acute{\alpha}$. FIG. 6 shows the exact opposite condition from a side plan view where third compartment 26 is more inflated than first compartment 18 and second compartment 20 (i.e., the patient has been turned in the other direction).

By turning the patient 10 in one direction and then the other, it is believed to assist in the cleaning capability of the buttocks of a patient 10 and as well as assist in changing the diaper 24. Furthermore, gap 22 is useful in removing a replaced diaper 24 and inserting a new diaper 24.

When changing the diaper 24, it is anticipated that the patient 10 will first be elevated to create the gap 22 by just raising first compartment 18 in elevation and/or more of the compartments such as second compartment 20 or third compartment 26 or even other compartments second or third compartment may be selectively inflated and/or deflated to achieve a desired alpha ($\acute{\alpha}$) angle. The caregiver may then undo the front part of the diaper 24 and then roll the patient 10 to the position shown in FIG. 5 by operating the fluid transfer system 16. It is important to remember that the fluid transfer system 16 may be as basic as a pump which cooperates with one or more valves 28,30,32,34,36,38 so that the desired position shown in FIG. 5 is achieved.

The used diaper 24 can then be partially moved out of the way when the patient 10 is in this position or the caregiver can push the patient 10 further over as they will turn relatively easy in this position due to the leverage achieved by the second compartment 20 relative to the third compartment 26. Furthermore, the patient's buttocks and other parts can be cleaned relatively easy when in this position. The diaper 24 is then put at least partially in place and the patient 10 can then be rolled over to the position shown in FIG. 6 on top of the new diaper 24 and completely off the old diaper 24 and the diaper can then be reattached as shown in FIG. 6 to complete the process or the patient 10 rolled back into position shown in FIGS. 1 and 2 to complete the process with the new diaper 24 after having being cleaned in the position shown in FIG. 5 and FIG. 6 to provide at least a relatively clean patient 10. The compartments 18,20,26 can then be deflated, if not already deflated.

It is important to remember that bed sores can be caused, in addition to pressure, by unclean or relatively poorly cleaned patients 10. Cleaning when replacing diapers 24 is usually important for the patient's health.

By utilizing the method and devices shown herein, it is easier to change diapers. Furthermore, it is believed to significantly cut Workers' Compensation claims. In fact, the fluid transfer system 16 could be automated and utilized with joy sticks so that upon actuation of a joy stick the desired inflation and deflation of relative compartments such as first compartment 18, second and third compartments 20,26 can be provided to provide the desired rotation of the patient 10. Although the three compartments 18,20,26 are illustrated, it can be provided with more compartments 10,20,26 or possibly fewer compartments 18,20,26 could be utilized in various other embodiments. The moving device 14 could be made to be disposable or more of a reusable product. Furthermore, it could be made to support the weight of an adult, a child or even an extremely heavy or even grossly obese individual depending on the particular construction of the particular design.

Figure 7:
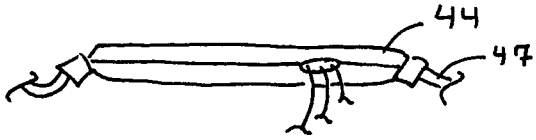
FIG. 7 is a side plan view showing fluid connections, connection straps and covering of an alternatively preferred embodiment of the present invention.

FIG. 7 shows a covering 44 such as a pillow case type construction having openings at the corners where straps, such as elastic straps 47 connected to exterior surfaces 48 of the bladder 46 or other structure can connect the moving system 14 to a bed or other structure.

The fluid transfer system 16 could be on a rolling cart and provide a location for the spent diapers 24 as well as the new diapers 24 and an air or other fluid pump on the cart. Various conduits such as air hoses, etc., could be utilized for the conduits 40,42. In addition to rolling the patient back and forth for changing a diaper or other procedure, the moving system 14 and the fluid transfer system 16 could be made also to slightly adjust the position of the patient 10 relative to the bed 12. In fact, the fluid transfer system 16 could have an automated system which gradually or periodically moves the patient 10 relative to the bed 12 to adjust his or her position so that limited caregiver assistance is all that is required, if any. This is believed to generate huge savings for taxpayers through Medicare expenses of treating a patient from a nursing home for bed sores. As for a relatively inexpensive expenditure for the moving assembly 14 and a fluid transfer system 16, the patient could be moved at least every two to four hours if not more often or even continuously in an attempt to minimize if not eliminate the occurrence of bed sores.

Figure 8:
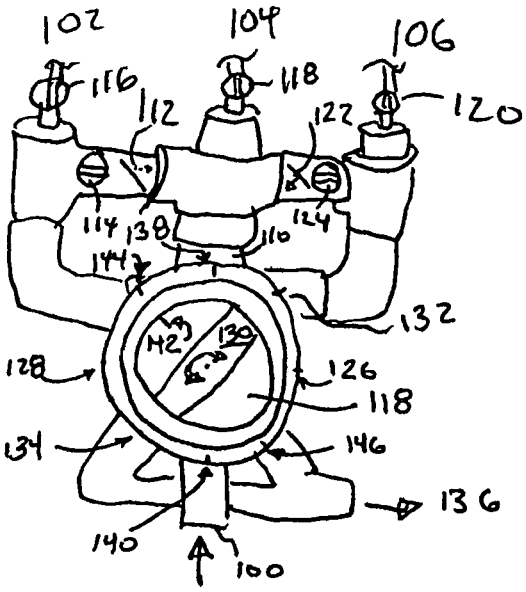
FIG. 8 is front plan view of a portion of an embodiment of a fluid transfer system used with the turning assembly shown in FIG. 1.
Figure 9:
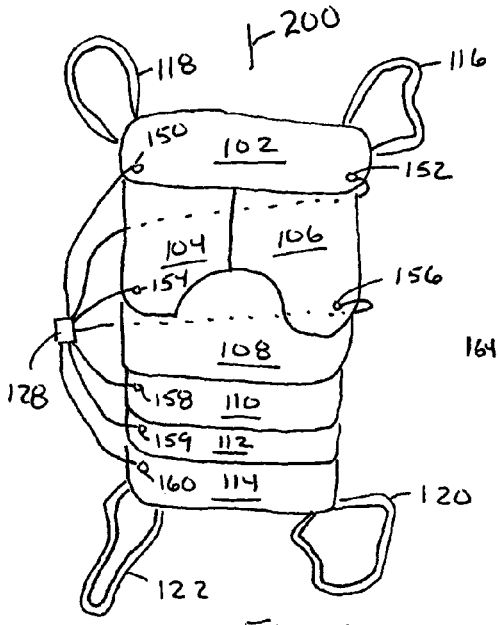
FIG. 9 is a top plan view of a presently preferred embodiment of the present invention.

FIG. 8 shows detail of valving associated with one presently preferred embodiment of a fluid transfer station 16. Other valving arrangements could be provided in other embodiments. In this embodiment, supply source, such as from an air compressor or other supply (not shown), provides inlet 100 with fluid. The fluid to the inlet 100 can be directed to at least one, if not all three outlets 102, 104, 106 which are preferably directed to each of the three compartments 18,20, 26 shown in FIG. 3. The air vent/supply valve 108 can be turned (about 20 degrees in the embodiment illustrated) to align inlet 100 with supply 110. This then provides communication to each of the outlets 102, 104, 106 as long as valves 112, 114, 116, 118, 120, 122, 124 are open. Valves 112 and 122 are preferably one-way valves which open upon a pressure differential with a higher pressure on the side of supply 110 as opposed to respective outlets 102,104,106.

After filling the compartments 18,20,26 a desired amount, the air supply source can be secured and/or the air/vent valve 108 turned to a position which does not align the inlet 100 with supply 100 such as with communicator 130 aligning with positions 126 and 128 for valve 118 ("off", for this embodiment). To vent the first and second compartments 18, 20, the communicator 130 may be turned to the position illustrated in FIG. 8 and with valves 118, 120 and 124 open, valve 122 will open due to the pressure differential and air will vent from outlets 104, 106 through positions 132 and 134 and out vent outlet 136. Wall 142 seals off position 138 and 140 and preferably positions 144 and 146 and one way valve 112 prevents air flow from outlet 102 out vent outlet 136 when in this configuration. One skilled in the art will see a similar effect when the communicator is turned to align with positions 144 and 146 in the preferred embodiment. Of course valves 114,116 118 120 and 124 and/or others may be utilized to only allow air to vent from one or more compartments at a time. Valves such as valve 108, 112, 114, 116,118,120, 122, 124 may be automatically, manually and/or otherwise operated with signals from a processor, handles, etc. A processor, not shown, may measure inflation in time and/or pressure in any of the various compartments 18, 20, 26 which may provide feedback to control inflation. The processor may also control periodic patient movement of the patient 10 as described above.

The preferred embodiment of the present invention is a decreased risk to the patient 10 in terms of the possibility of bed sores, a decreased risk to the caregiver in that it should virtually eliminate back injuries caused by pushing and pulling patients 10 in an effort to overcome gravity and further increase the comfort to the patient 10 as the patient is not being manhandled by the caregiver. Another advantage of the presently preferred embodiment of the present invention is that it allows older individuals to take care of their loved ones since physical strength would potentially no longer be necessary to change the diaper 24 of a patient 10. Very little upper body strength would be required to change a diaper 24.

While the first turning assembly 14 worked for its intended purpose, the applicant discovered during its construction and implementation that improvements over the initial design were discovered to provide increased patient comfort for at least some applications. Accordingly, the embodiments of FIGS. 9-13 were developed and have been implemented.

Head support 102 is located above at least one first fluid blocker illustrated as left and right turning sections 104,106. Cavity section 108 is provided which facilitates the provision of a gap as discussed below. Upper leg lift section 110 is preferably provided along with lower leg lift section 112. Finally, step platform 114 may be provided in various embodiments. Furthermore, instead of being about half of a bed length product as the embodiment is illustrated in FIG. 1, as can be seen in FIGS. 9-13, the preferably preferred embodiment of turning assembly 100 can extend substantially the length of the entire bed 126. Furthermore, in a deflated condition, the product can be made to have substantially no significant height. The turning assembly 100 can virtually disappear under a sheet 135 when not in use. Elastic bands 116, 118, 120,122 or other connectors can be utilized to assist in retaining the turning assembly 100 to the bed 126 as illustrated in FIGS. 10-13 such as at corners of the turning assembly 100 and/or bed 126.

Controller 128 is useful to adjust the inflation/deflation under various sections 102,104,106,110,112,114 in a similar or dissimilar manner as provided in the preferred embodiment of the turning assembly 14. Sections 102,104,106,110, 112,114 are preferably separate fluid compartments in the illustrated embodiment, but other embodiments may combine compartments, fluidly couple compartments, omit certain compartments and/or provide additional compartments.

Figure 10:
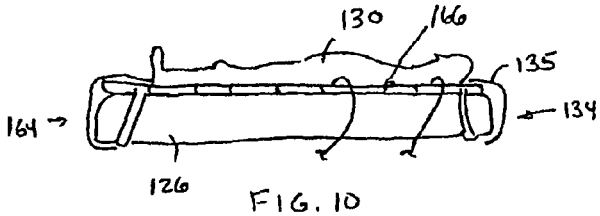
FIG. 10 is a side view of the embodiment of FIG. 9 in a first mode of operation.
Figure 11:
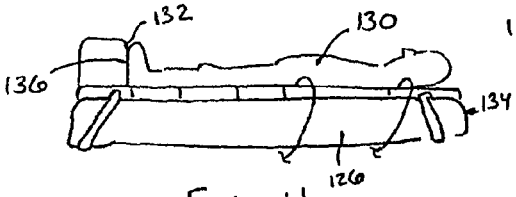
FIG. 11 is a side view of the embodiment of FIG. 9 in a second mode of operation.
Figure 12:
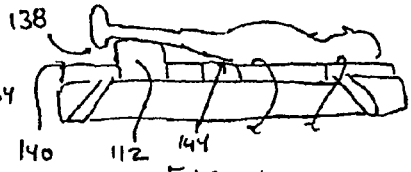
FIG. 12 is a side view of the embodiment of FIG. 9 in a third mode of operation.
Figure 13:
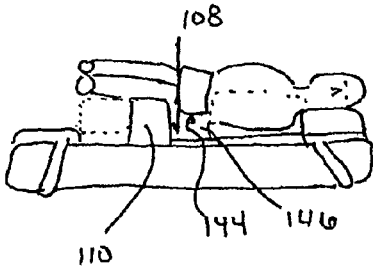
FIG. 13 is a side view of the embodiment of FIG. 9 in a fourth mode of operation.

FIG. 10 shows a first mode of operation which all the sections 102,104,106,110,112,114 are deflated. The sections 102,104,106,110,112,114 are air bladders and/or fluid compartments, preferably separated from one another in the preferred embodiment. The patient 130 is illustrated resting flat on a bed 126 with the turning assembly 100 taking up virtually no height and in some embodiments roughly a millimeter more so or even less. Various operations shown in FIGS. 11-13, and/or various modes can be provided. Specifically, a step platform 114 can be provided by inflating step platform 114 so the patient can have a step 132 to assist in pushing his or herself back towards the top 134 of bed 126. This is particularly useful when certain portions of the hospital bed are elevated. The step 132 is preferably located below the foot 136 of the patient 130.

In a second alternatively preferred embodiment, a lower leg section 112 can be inflated to at least partially elevate the patient's heel 138 above the upper surface 140 of at least one of the bed 126 and turning assembly 100 while being spaced from the lower leg section 112. Other embodiments may just reduce pressure on the heel without such spacing by partially inflating/deflating particular sections, such as section 112 and/or others. Bed sores on the heels are a common phenomena for which the selected inflation and deflation of lower leg section 112 could assist in preventing. This may be performed automatedly and/or periodically with processor or controller 128. In fact, the automated process may be stopped with controller 128 to change a diaper as described above and then resumed.

Unlike the embodiment of FIGS. 1-8 such as is shown in FIG. 6 instead of providing a first compartment 18, turning sections 104,106 are provided adjacently and which may have cutout 142 at the area of a patient's buttocks 144 to facilitate in the exchange of a bedpan and/or the changing of a diaper. Both turning sections 104,106 (at least one first compartment) can be inflated symmetrically relative to patient axis 200 or otherwise to elevate the patient. In the illustrated embodiment, only section 104 is shown elevated thereby turning patient. However, what distinguishes this embodiment from the embodiment of FIG. 6 is that upper leg portion 110 (third section) is also inflated thereby providing an intentional gap 146 between the buttocks 144, the upper surface of cavity 108 and the first or turning section 104 if not also 106 and the upper leg section 110. By lifting the patient 110 together with the first section 104 and/or 106, easier access is provided to be able to change bedpans and/or diapers. The various sections such as head section 102 (fourth section), the turning section(s) 104,106, the upper leg section 110, the lower leg section 110 (fifth section) and the step platform 114 (sixth section) preferably all have at least one inflation/deflation access 150,152,154,156,158,160,162. Two inflation accesses 150,152 are useful for the head support 102 because of the head normally being roughly in the middle, head support 102 inflating on one side the position of the head could create a temporary bind as it relates to the inflation of the head support 102. Head support 102 may preferably be inflated with the inflation of at least one of the turning sections 104,106 to support the head of a patient.

The third compartment or upper leg section 110 can be maintained inflated or not relative to the inflation or deflation of turning sections 104,106 (the at least one first section). Alternatively, the inflation/deflation of turning sections 104, 106 thereby turns the patient while maintaining the third section inflated such as upper leg section 110 and/or lower leg section 112.

In operation, it has been discovered that a 90 pound nurse can lift a 300 pound patient with a single finger. Furthermore, controller 128 can be provided with a blower or other fluid transfer device as roughly less than a pound of pressure can successfully inflate the various sections 102,104,106,110,112,114 turning assembly 100. In fact, less than a pound of pressure roughly 670 pounds have been tested with actual units in operation. The turning assembly 100 of the presently preferred embodiment connects to top 134 and bottom 164 portions of bed 126 with the bands 116,118,120, 122 which other connection mechanism be provided in embodiments. In fact, the turning assembly 100 substantially covers the entire upper surface 166 of bed 126 in the presently preferred embodiment.

Controller 128 can be provided with lights or other indicia to advise an operator as to time to turn the patient 130 and/or automatedly inflate or deflate certain sections such as particular sections such as 104 and 106 to assist in left to right movement. Furthermore, the sections 104,106 can be simultaneously inflated and/or either one of turning section 104, 106 can be inflated more than the other (if the other is inflated at all). Furthermore, lower leg section 112 may be inflated and deflated in order to relieve pressure off of the heels 138 similarly or dissimilarly as described above.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of using a moving assembly for use with a patient on an at least substantially horizontal surface comprising:

providing a moving station having a first fluid bladder configured to be placed on a horizontal surface proximate to and below the buttocks of a patient, a second fluid compartment with the first fluid compartment located intermediate the second fluid compartment and the at least a portion of the buttocks, a third fluid bladder with the first fluid bladder located intermediate the third fluid bladder and the at least a portion of the buttocks, at least partially inflating at least the first fluid bladder with a fluid transfer system whereby at least a portion of the buttocks of the patient are lifted and suspended a distance above the horizontal surface separated by an access gap intermediate the at least the portion of the buttocks and the horizontal surface;

and then at least one of inflating and deflating the second fluid bladder thereby at least assisting in turning the patient;

at least one of inflating and deflating the third fluid bladder thereby at least assisting in turning the patient, deflating the at least one fluid bladder after changing a diaper worn by the patient.

2. The method of claim 1 wherein the second and third fluid bladders are located proximate to and below respective first and second shoulders of the patient.

3. The method of claim 2 wherein the second and third fluid bladders are at least substantially symmetrically disposed relative to the patient.

4. The method of claim 2 further comprising the step of inflating the second and third fluid bladders and then deflating a selected one of the first and second fluid bladders thereby turning the patient.

5. The method of claim 1 wherein when performing the step of changing the diaper, after lifting the patient with at least the first bladder at least partially inflated, performing a selected step of at least one of removing a potentially soiled diaper and installing a new diaper in the access gap through a process having a step of turning the patient by at least one of inflating and deflating the second fluid bladder.

6. The method of claim 5 wherein when performing the step of changing the diaper, after lifting the patient with at least the first bladder at least partially inflated, the selected step is performed through a process having a step of turning the patient by at least one of inflating and deflating the third fluid bladder.

7. The method of claim 1 wherein after changing the diaper, a controller automatedly inflates and deflates at least certain fluid bladders.

8. A method of using a moving assembly for use with a patient on an at least substantially horizontal surface comprising:

providing a moving station having a first fluid bladder compartment located proximate to the buttocks of the patient, a second fluid bladder configured to be placed on the horizontal surface proximate to a first shoulder of a patient, and a third fluid bladder compartment located proximate to a second shoulder of the patient, at least partially inflating at least the first fluid bladder with a fluid transfer system whereby at least a portion of the buttocks are suspended a distance of an access gap above the horizontal surface intermediate the horizontal surface and at least a portion of the buttocks, and at least partially inflating at least the second fluid bladder with a the fluid transfer system whereby the first shoulder of the patient is lifted a distance above the horizontal surface; and then deflating the at least the second bladder; wherein at least one of the steps of inflating and deflating the second fluid bladder steps turns the patient and deflating the at least one fluid bladder after changing a diaper worn by the patient and at least partially inflating at least the third fluid bladder with the fluid transfer system whereby at least the second shoulder of the patient is lifted a distance above the horizontal surface; and then deflating the third fluid bladder; wherein at least one of the steps of inflating and deflating the third fluid bladder turns the patient.

9. The method of claim 8 wherein after changing the diaper, a controller automatedly inflates and deflates at least certain fluid bladders.

* * * * *